US005521684A

United States Patent [19]

Takahashi

[11] Patent Number: 5,521,684

[45] Date of Patent: May 28, 1996

[54] IMAGE FORMING APPARATUS INCLUDING OPTICAL ELEMENT FOR OPTICALLY DETECTING AMOUNT OF DEVELOPING AGENT IN DEVELOPER

[75] Inventor: Koji Takahashi, Yokohama, Japan

[73] Assignee: Canon Kabushiki Kaisha, Tokyo, Japan

[21] Appl. No.: 337,384

[22] Filed: Nov. 8, 1994

[30] Foreign Application Priority Data

Nov. 25, 1993 [JP] Japan ..... 5-317550

[51] Int. Cl.[6] ..... G03G 21/00

[52] U.S. Cl. ..... 355/246; 118/694; 355/203

[58] Field of Search ..... 355/203, 208, 355/246, 260; 118/688, 689, 691, 694

[56] References Cited

U.S. PATENT DOCUMENTS 5,398,106 3/1995 Eguchi ..... 355/260

5,428,427 6/1995 Lee ..... 355/246

FOREIGN PATENT DOCUMENTS 63-2087 7/1988 Japan .

2-284165 11/1990 Japan .

*Primary Examiner*—William J. Royer

*Attorney, Agent, or Firm*—Fitzpatrick, Cella, Harper & Scinto

[57] ABSTRACT

An image forming apparatus includes an image carrier, a developer for developing an electrostatic latent image on the image carrier, a transfer device for transferring the developed image on the image carrier onto a transfer medium, a feed device for feeding the transfer medium to a transfer portion by the transfer device, and an optical element for optically detecting the amount of developing agent in the developer. The optical element is arranged at a side opposite to the developer with respect to the convey path of the transfer medium.

13 Claims, 9 Drawing Sheets

IMAGE FORMING APPARATUS INCLUDING OPTICAL ELEMENT FOR OPTICALLY DETECTING AMOUNT OF DEVELOPING AGENT IN DEVELOPER

BACKGROUND OF THE INVENTION

1. Field of the Invention

The present invention relates to an image forming apparatus such as a copying machine, a printer, a facsimile apparatus, or the like and, more particularly, to an image forming apparatus which optically detects the remaining amount of a developing agent.

2. Related Background Art

As a conventional developing agent presence/absence detection device in an electrophotography apparatus or the like, a light-transmitting type developing agent presence/absence detection device, in which a photointerrupter is formed by arranging a light source and a light-receiving element to oppose each other, and which detects the presence/absence of a developing agent therebetween, is known (Japanese Laid-Open Patent Application No. 63-2087).

FIG. 11 is a sectional view showing a principal part of an example of a light-transmitting type device for detecting the presence/absence of a developing agent. In FIG. 11, the device includes a light-emitting element 101, a light-receiving element 102, and a developing agent container 103, which has windows 104 and 105 for passing light at positions opposing the light-emitting element 101 and the light-receiving element 102.

In this device, while the developing agent container 103 stores a sufficient amount of developing agent D, light emitted from the light-emitting element 101 and entering the developing agent container 103 via the window 104 is interrupted by the developing agent D, and does not reach the light-receiving element 102. On the other hand, when the developing agent container 103 becomes empty upon consumption of the developing agent D, light emitted from the light-emitting element 101 passes through the windows 104 and 105, and reaches the light-receiving element 102. In this manner, the presence/absence of the developing agent D is detected based on a change in output from the light-receiving element 102.

A window cleaning member 106 is pivotally driven by a driving source (not shown) about a rotational shaft 107 as the center of rotation. A cleaning sheet 108 consists of a flexible member, and contacts the inner surface of the window 104 or 105 upon pivotal motion of the window cleaning member 106 to wipe off developing agent D which becomes attached to the inner surface of the window 104 or 105. Thus, the presence of the developing agent can be prevented from being erroneously detected due to developing agent D which becomes attached to the windows and shields light emitted from the light-emitting element 101 although the developing agent container 103 is empty.

In such a light-transmitting type developing agent presence/absence detection device, a drop in detection accuracy due to attachment of dust to a light-emitting portion and a light-receiving portion poses a problem. For example, in Japanese Laid-Open Patent Application No. 2-284165, the light-emitting portion or the light-receiving portion is flexibly held, and is kept in tight contact with the developing agent container. For this reason, dust attachment prevention performance can be improved as compared to a type in which the light-emitting portion and the light-receiving portion are simply fixed. Furthermore, this reference also proposes a mechanism for cleaning the light-emitting portion and the light-receiving portion in synchronism with attachment/detachment of the developing agent container or opening/closing of a door.

However, although the type in which the light-emitting portion or the light-receiving portion is kept in tight contact with the developing agent container is effective in terms of dust attachment prevention, if the light-emitting portion or the light-receiving portion cannot be arranged in tight contact with the developing agent container due to a limitation in the layout of the apparatus, then the effect cannot be expected, as a matter of course. The convey path of a recording medium is the most important limitation in the layout of the apparatus, and is often located near the developing agent container to make the apparatus compact as a whole.

In particular, when the convey path extends just below the developing agent container (immediately therebelow in the vertical direction), the light-emitting portion and the light-receiving portion cannot be arranged immediately below the developing agent container, and must be arranged to avoid the convey path.

In this case, however, the presence/absence of the developing agent in a bottom portion of the developing agent container cannot be detected.

For this reason, upon detection of the absence of the developing agent, some portion of the developing agent still remains on the bottom portion, resulting in an uneconomical arrangement.

SUMMARY OF THE INVENTION

It is an object of the present invention to provide an image forming apparatus, which can detect the presence/absence of a developing agent in a bottom portion of a developer.

It is another object of the present invention to provide an image forming apparatus comprising an image carrier, a developer for developing an electrostatic latent image on the image carrier, transfer means for transferring the developed image on the image carrier onto a transfer medium, feed means for feeding the recording medium to a transfer portion by the transfer means, and an optical element for optically detecting an amount of developing agent in the developer, the optical element being arranged at a side opposite to the developer with respect to a convey path of the transfer medium.

Other objects of the present invention will become apparent from the following description.

DESCRIPTION OF THE PREFERRED EMBODIMENTS

The preferred embodiments of the present invention will be described hereinafter with reference to the accompanying drawings.

(First Embodiment)

The first embodiment of the present invention will be described below with reference to FIGS. 1 to 3, 4A, 4B, 5 to 7, 8A and 8B.

Figure 1:
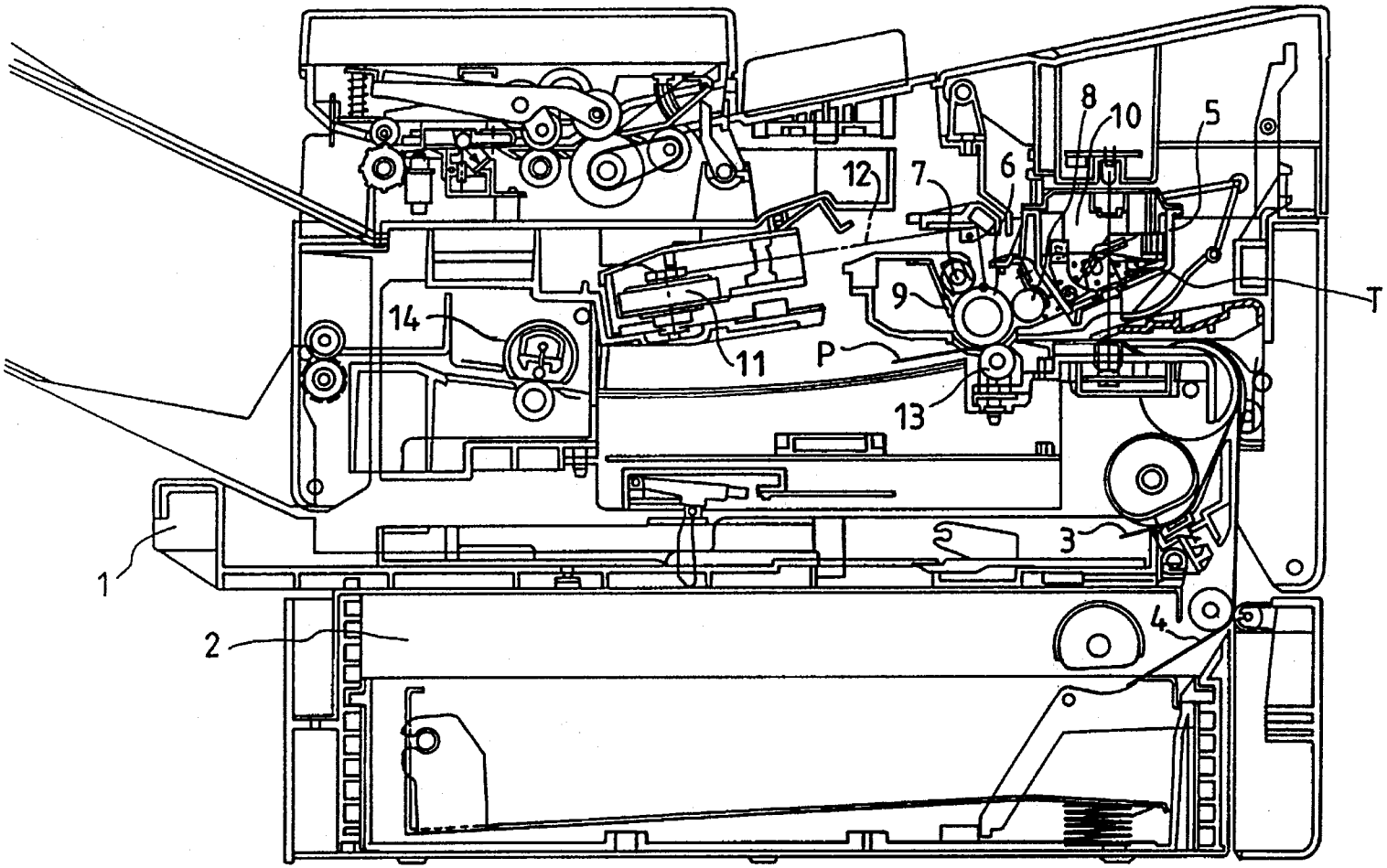
FIG. 1 is a sectional view of a facsimile apparatus according to an embodiment of the present invention.

FIG. 1 is a sectional view of a laser exposure type facsimile apparatus as an image forming apparatus according to an embodiment of the present invention.

In the apparatus of this embodiment, a recording medium (transfer medium) P picked up from a paper cassette 1 or 2 is fed along a respective recording medium convey path 3 or 4, is subjected to image formation via predetermined processes, and is discharged outside the apparatus.

Referring to FIG. 1, a process cartridge 5 is detachably attached to an apparatus main body, and integrally houses a photosensitive drum 6, a primary charger 7, a developer 8, a cleaning device 9, and a developing agent container 10 which stores a developing agent powder T.

The image formation process in this facsimile apparatus will be explained below. After the photosensitive drum 6 is uniformly charged by the primary charger 7, image light (laser beam) 12 is irradiated from a light source 11 onto the photosensitive drum 6, thereby forming an electrostatic latent image on the photosensitive drum 6. The electrostatic latent image is developed and visualized by the developing agent (toner) T in the developer 8 to be converted into a toner image. The toner image on the photosensitive drum 6 is transferred onto the recording medium P by a transfer charger 13 on the apparatus main body side, and the toner image carried on the recording medium P is fixed by a fixing device 14. Thereafter, the recording medium P is discharged outside the apparatus. On the other hand, any residual toner on the photosensitive drum 6, which has finished the transfer process, is cleaned by the cleaning device 9 to prepare for formation of the next electrostatic latent image.

Figure 2:
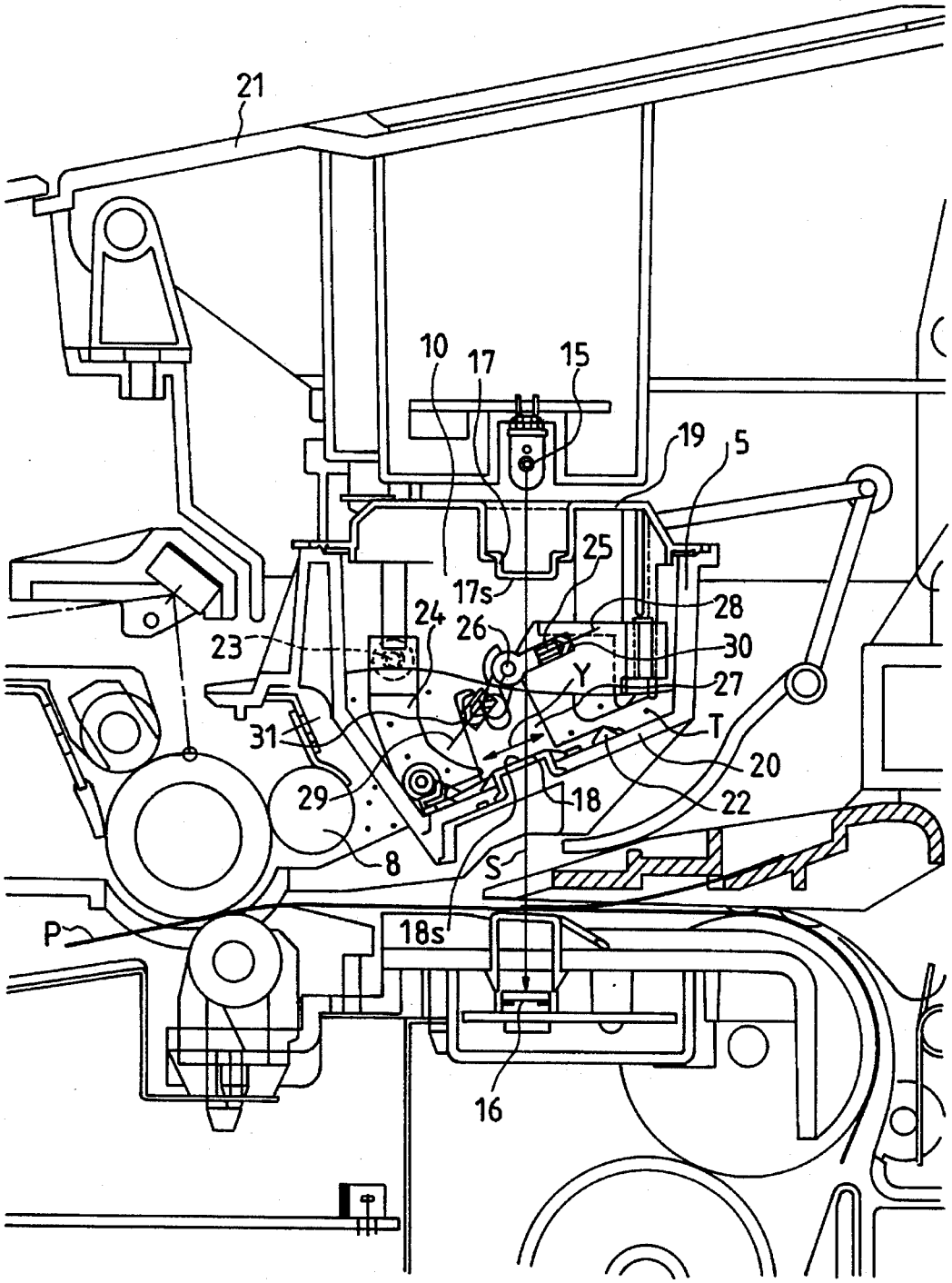
FIG. 2 is a sectional view of a developing agent presence/absence detection device according to the first embodiment of the present invention.

FIG. 2 is an enlarged view of a principal part in FIG. 1, i.e., a longitudinal sectional view of a developing agent presence/absence detection device of the present invention. A light-emitting element 15 and a light-receiving element 16 are attached to the apparatus main body to oppose each other, and are connected via an optical axis S.

Transparent windows 17 and 18 are respectively formed on a top surface wall 19 and a bottom surface wall 20 of the developing agent container 10. Of these windows, the transparent window 18 on the bottom surface wall side is formed almost at the lowest level position of the developing agent container 10. Note that "transparent" here means that light emitted from the light-emitting element 15 is allowed to pass therethrough, and the window need not be visibly transparent.

Figure 3:
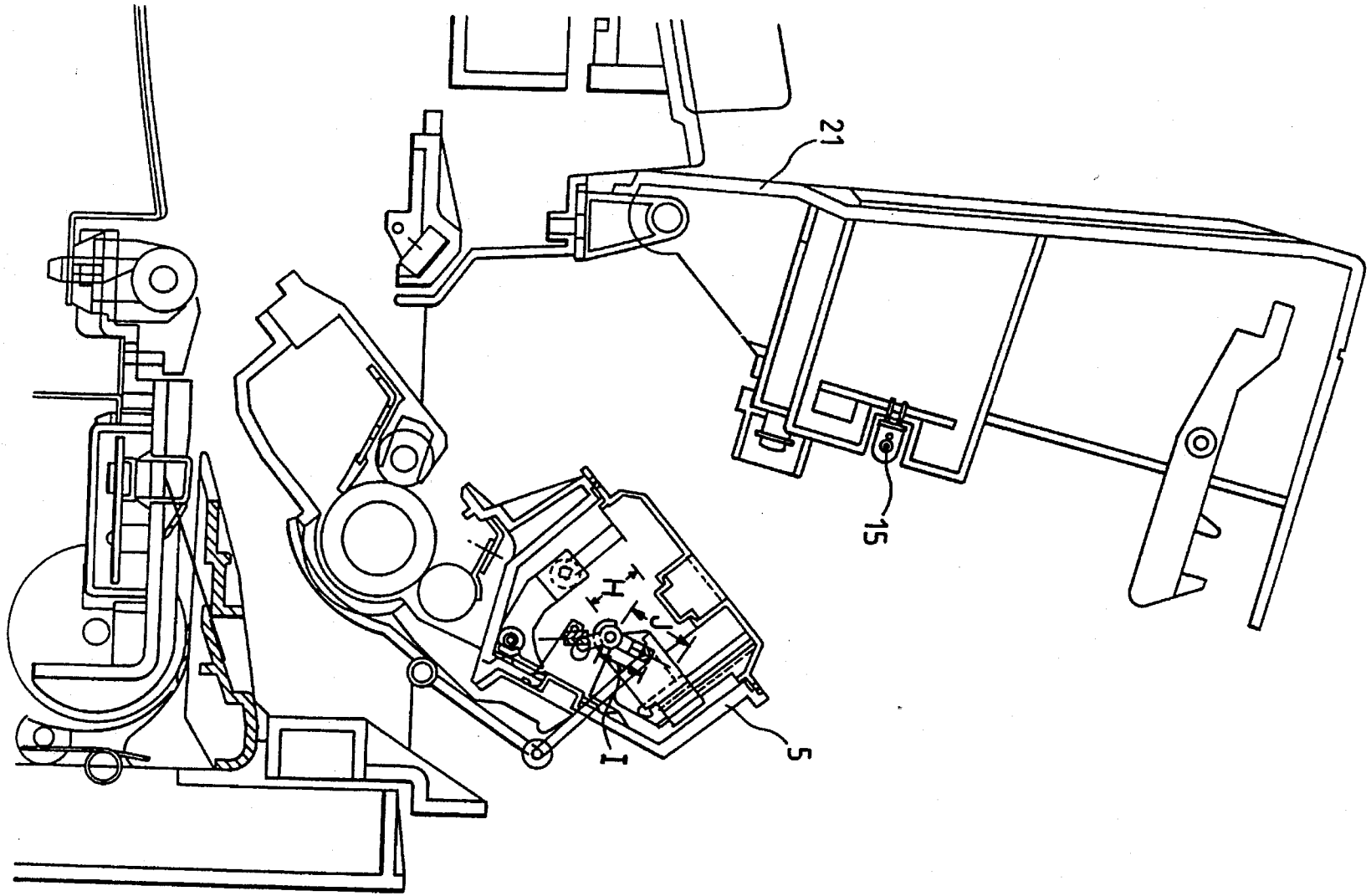
FIG. 3 is a view showing a state wherein a cartridge cover of the facsimile apparatus in the first embodiment of the present invention is opened.

The positional relationship among the light-emitting element 15, the light-receiving element 16, and the transparent windows 17 and 18 is determined as follows. That is, in a state wherein the process cartridge 5 is attached to the apparatus main body, the light-emitting element 15 and the light-receiving element 16 are located to sandwich the developing agent container 10 therebetween, and the transparent windows 17 and 18 respectively oppose the light-emitting element 15 and the light-receiving element 16. The light-emitting element 15 is attached to a cartridge cover 21 which is openable/closeable with respect to the apparatus main body. Upon exchange of the process cartridge 5, as shown in FIG. 3, the light-emitting element 15 is withdrawn upward together with the cartridge cover 21. The light-receiving element 16 is attached below the convey path of the recording medium P, as will be described later.

Referring to FIG. 2, an agitating plate 22 is arranged in the developing agent container 10, and is reciprocally moved in the direction of an arrow Y by an agitating arm 24 which makes a pendulum motion about an agitating shaft 23, so as to supply the toner T into the developer 8 and to prevent cohesion and local presence of the toner T. A cleaning member 25 is supported by a pivot shaft 26, and is reciprocally pivoted through about 100° by a pawl portion 27 on the agitating plate 22. The pivot shaft 26 of the cleaning member 25 is arranged at a position separated by the same distance from the transparent windows 17 and 18. The cleaning member 25 has a notched window near its center so as not to interrupt the optical axis S. Cleaning blades 28 and 29 each consist of a flexible member, and are respectively attached to distal edges 30 and 31 of the notched window.

A distance H between the pivot shaft 26 and a window surface 17S (18S), a distance I between the pivot shaft 26 and the distal edge 30 (31) of the notched window, and a distance J between the pivot shaft 26 and the distal end of the cleaning blade 28 (29) are determined to satisfy a relation $I<H<J$ (see FIG. 3). For this reason, when the cleaning member 25 is reciprocally pivoted, the cleaning blades 28 and 29 contact the window surfaces 17S and 18S to wipe off any toner attached to the window surfaces 17S and 18S. The optical axis S is interrupted only when the distal edges 30 and 31 of the notched window and the cleaning blades 28 and 29 cross the optical axis S, and the presence/absence of the toner can be detected while the distal edges 30 and 31 of the notched window and the cleaning blades 28 and 29 do not cross the optical axis S.

Figure 4A:
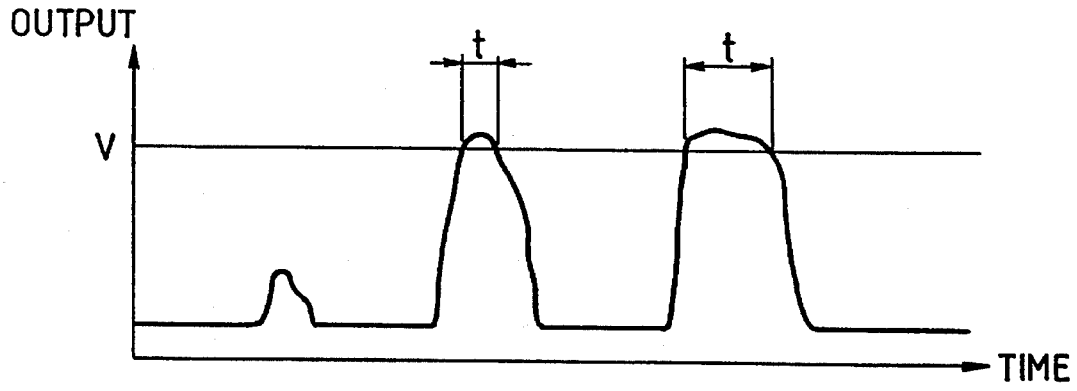
FIGS. 4A and 4B are charts for explaining the output signal from a light-receiving element in the first embodiment of the present invention.
Figure 4B:
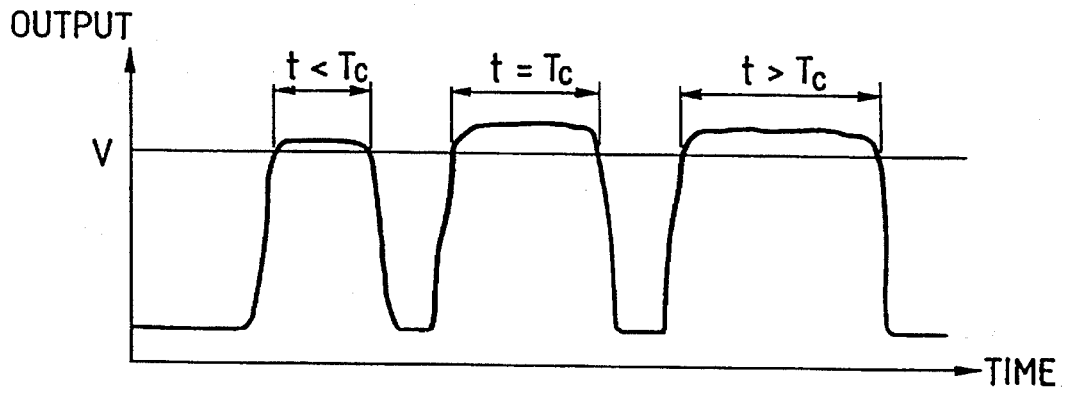

In the above-mentioned image formation process, the cleaning member 25 is reciprocally pivoted, and the cleaning blades 28 and 29 wipe off any toner attached to the window surfaces 17S and 18S. While the amount of toner T is sufficient, even when the cleaning blades 28 and 29 wipe off the toner on the window surfaces 17S and 18S, the toner T immediately covers the window surfaces. For this reason, light emitted from the light-emitting element 15 does not reach the light-receiving element 16 or is interrupted in a short period of time if it does reach the latter element. However, as the amount of toner decreases, the time required until the toner covers the windows after the windows are cleaned becomes longer. When the toner T is used up, light emitted from the light-emitting element 15 reaches the light-receiving element 16, except for a case wherein the distal edges 30 and 31 of the notched window and the cleaning blades 28 and 29 cross the optical axis S. When light emitted from the light-emitting element 15 reaches the light-receiving element 16, the output signal from the light-receiving element changes. FIGS. 4A and 4B show the output signal from the light-receiving element 16 during the detection process. While the amount of toner T is sufficient, the output is small, as shown in FIG. 4A, and a duration t of the signal of received light is short. However, when the toner is used up, the output becomes large, as shown in FIG. 4B, and the duration t of the light-receiving signal becomes longer. For this reason, if the light-receiving signal duration t is measured, and is compared with a predetermined value $T_c$ by a discrimination means, then the absence of the toner can be detected. In this embodiment, since one transparent window 18 (on the button surface wall side) is located almost at the lowest level position of the developing agent container 10, the "presence of toner" is determined up to a timing immediately before the toner T ceases to be supplied to the developer 8, and the remaining amount of toner upon determination of the "absence of toner" can be decreased, resulting in an economical arrangement.

Figure 5:
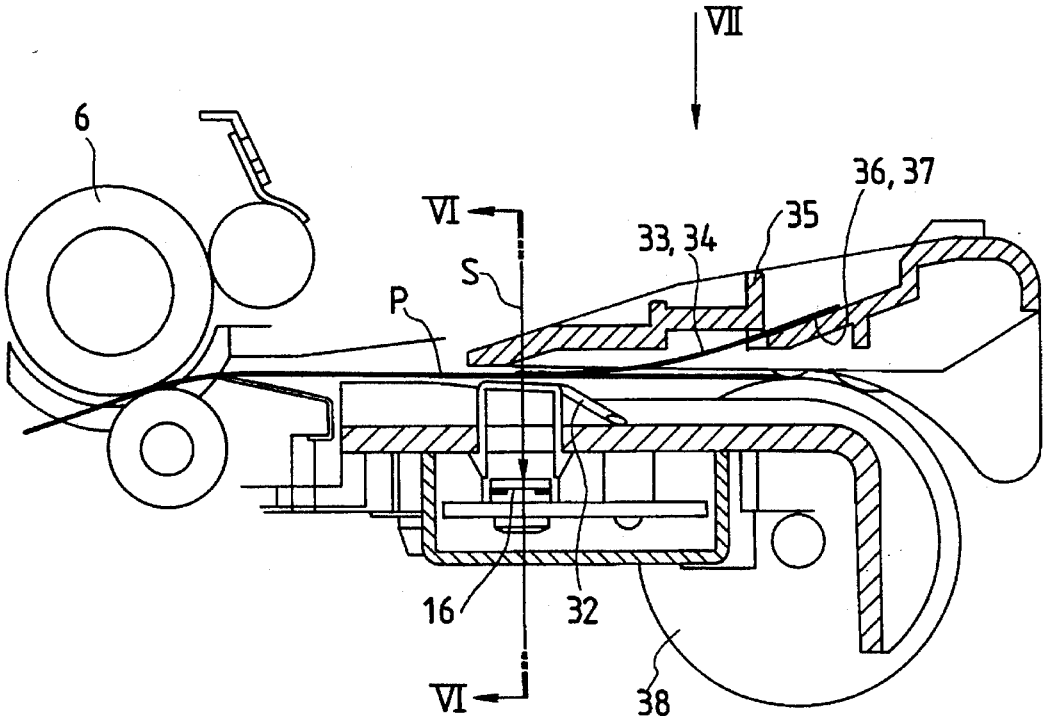
FIG. 5 is a detailed sectional view showing the arrangement near the light-receiving element in the first embodiment of the present invention.

This embodiment adopts a structure wherein the recording medium P passes just below the developing agent container 10 portion in the process cartridge 5, and the light-receiving element 16 is located underneath the paper feed surface. The presence/absence of toner is detected while the recording medium is not present on a portion, corresponding to the optical axis S, of the convey path (i.e., at a timing between two recording media or a timing before or after recording). FIG. 5 shows the details of the arrangement near the light-receiving element 16. The light-receiving element 16 is attached to a frame of the facsimile apparatus main body, and a dust attachment prevention cover 32 is attached to cover the element 16. The dust attachment prevention cover 32 consists of a transparent (light-transmitting) material. Note that "transparent" means that light emitted from the light-emitting element 15 is allowed to pass therethrough, and the cover 32 need not be visibly transparent. A portion, on the recording medium convey path upstream side (right side in FIG. 5), of the dust attachment prevention cover 32 has a tapered shape so as not to inadvertently catch the recording medium.

Figure 6:
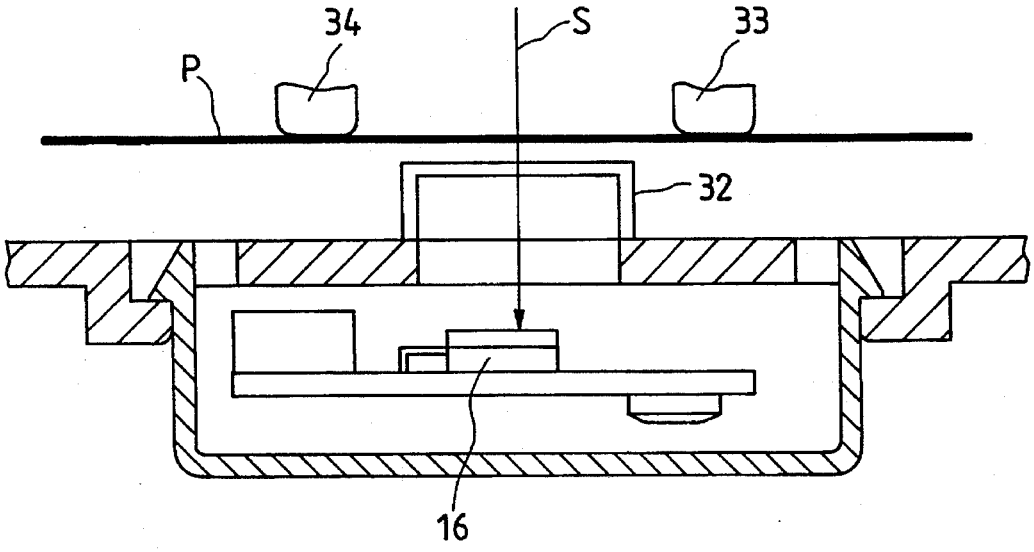
FIG. 6 is a sectional view taken along a line VI—VI in FIG. 5.
Figure 7:
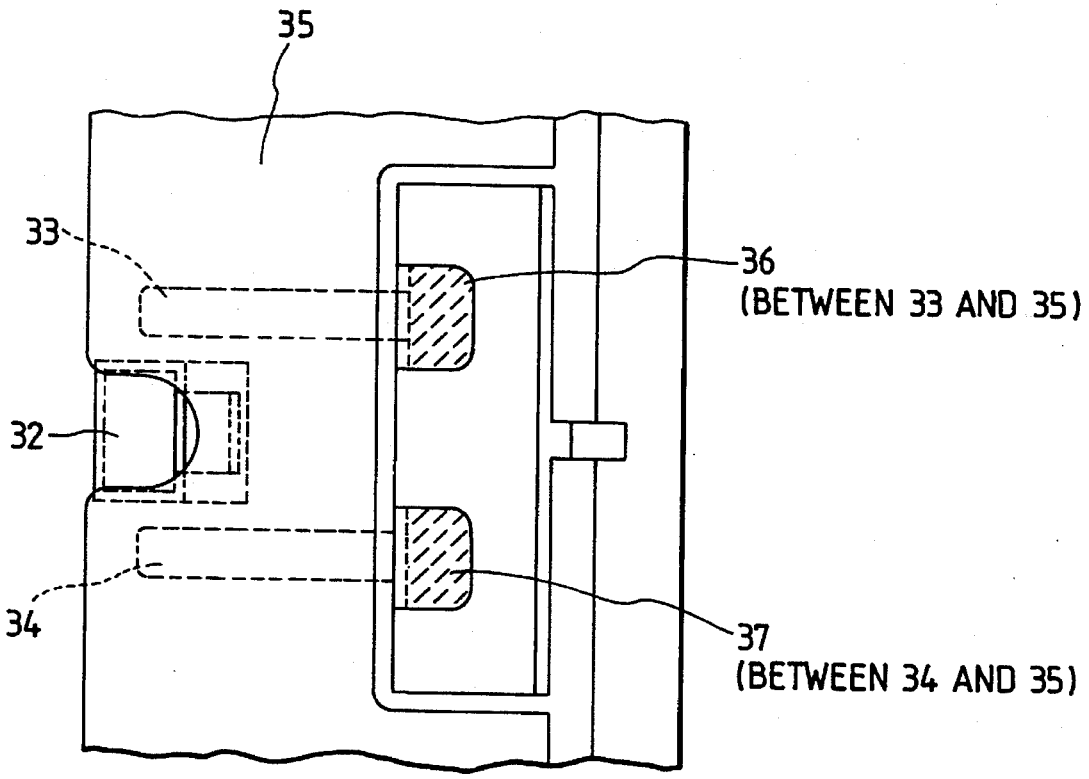
FIG. 7 is a plan view when viewed from the direction of an arrow VII in FIG. 5.

Flexible sheet guides 33 and 34 are arranged at two sides of the dust attachment prevention cover 32 to avoid the optical axis S, and bias the recording medium P to move toward the dust attachment prevention cover 32 with a weak force. The sheet guides 33 and 34 are attached to a convey guide 35 by double-sided tapes 36 and 37. FIG. 6 is a sectional view taken along a line VI—VI in FIG. 5, and FIG. 7 is a plan view when viewed from the direction of an arrow VII in FIG. 5.

Figure 8A:
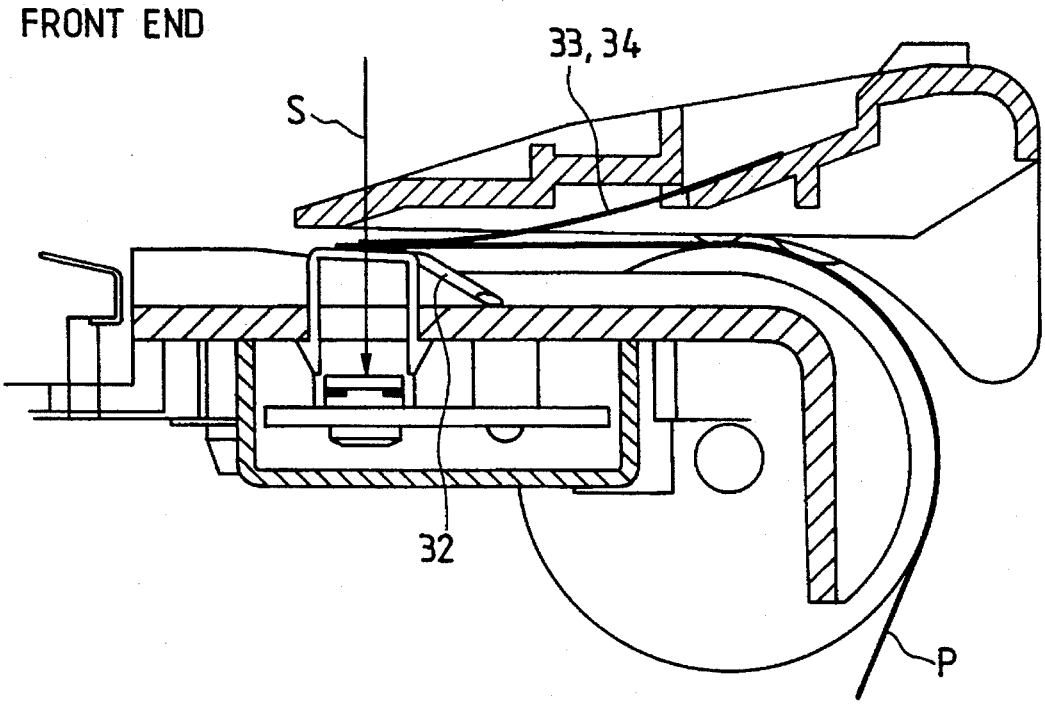
FIGS. 8A and 8B are explanatory views of an operation of a guide sheet in the first embodiment of the present invention.
Figure 8B:
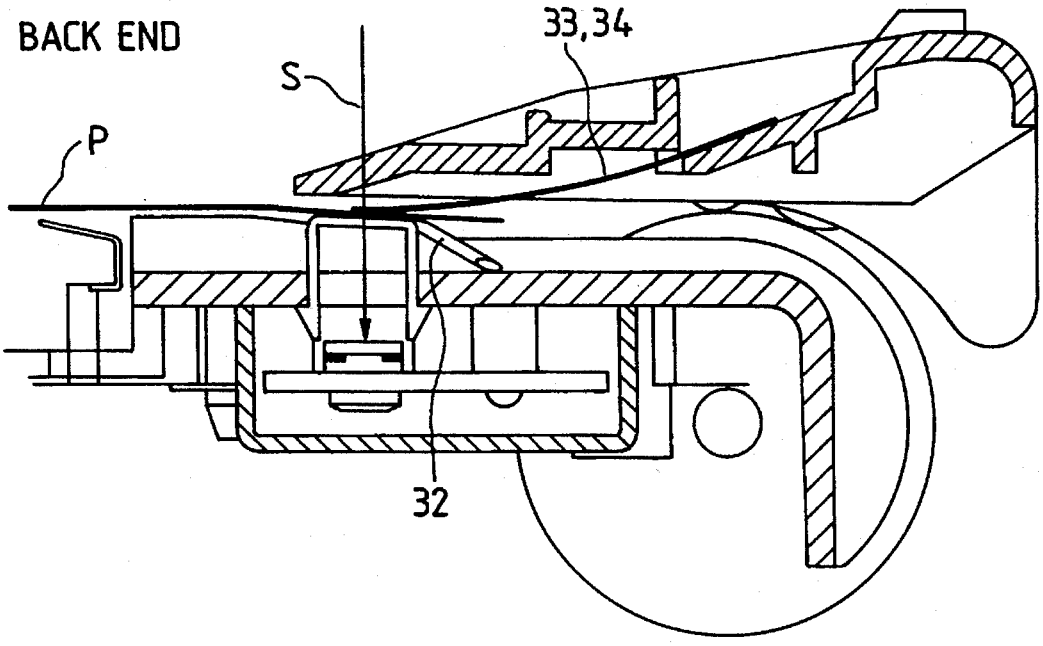

From the recording medium convey path, paper powder generated from the recording medium P, dust entering the apparatus upon attachment/detachment of the process cartridge 5, and the like fall onto the light-receiving element 16. The dust attachment prevention cover 32 prevents such paper powder and dust from being attached to the light-receiving element 16, and hence, prevents a decrease in output from the light-receiving element 16, thus maintaining high detection accuracy. Furthermore, since the sheet guides 33 and 34 bias the recording medium P to move toward the cover, dust falling on the cover is brushed off by the leading and trailing ends of the recording medium P upon passage of the recording medium P, as shown in FIGS. 8A and 8B. On the other hand, the surface (light-transmitting surface) of the dust attachment prevention cover 32 is lowered by about 1 mm from the level of the paper feed surface. For this reason, when the leading end of the recording medium P has reached the photosensitive drum 6, its trailing end still extends on a convey roller 38, and the recording medium P is stretched taut by a tension generated therebetween, as shown in FIG. 5, the sheet guides 33 and 34 are deformed and withdrawn, and the recording medium P does not contact the light-transmitting surface of the cover. Therefore, the light-transmitting surface of the cover can be prevented from being damaged to impair the detection accuracy. In this embodiment, the dust attachment prevention cover 32 consists of 1-mm thick polystyrene, and has a box shape of 15 mm (width)×10 mm (length)×5 mm (height). Each of the sheet guides 33 and 34 consists of a 0.075-mm thick polyester sheet, and has a size of 5 mm (width)×30 mm (length).

(Second Embodiment)

The second embodiment of the present invention will be described below. In the first embodiment, a flexible polyester sheet is used as a guide member. Alternatively, a metal leaf spring of, e.g., stainless steel, phosphor bronze, or the like may be used. In this case, since the stiffness is high, durability is improved. Such a structure is effective for a case wherein a thick, hard paper sheet is used as a recording medium.

(Third Embodiment)

The third embodiment of the present invention will be described below with reference to FIG. 9. The same reference numerals in FIG. 9 denote the same parts as in the first embodiment, and a detailed description thereof will be omitted.

Figure 9:
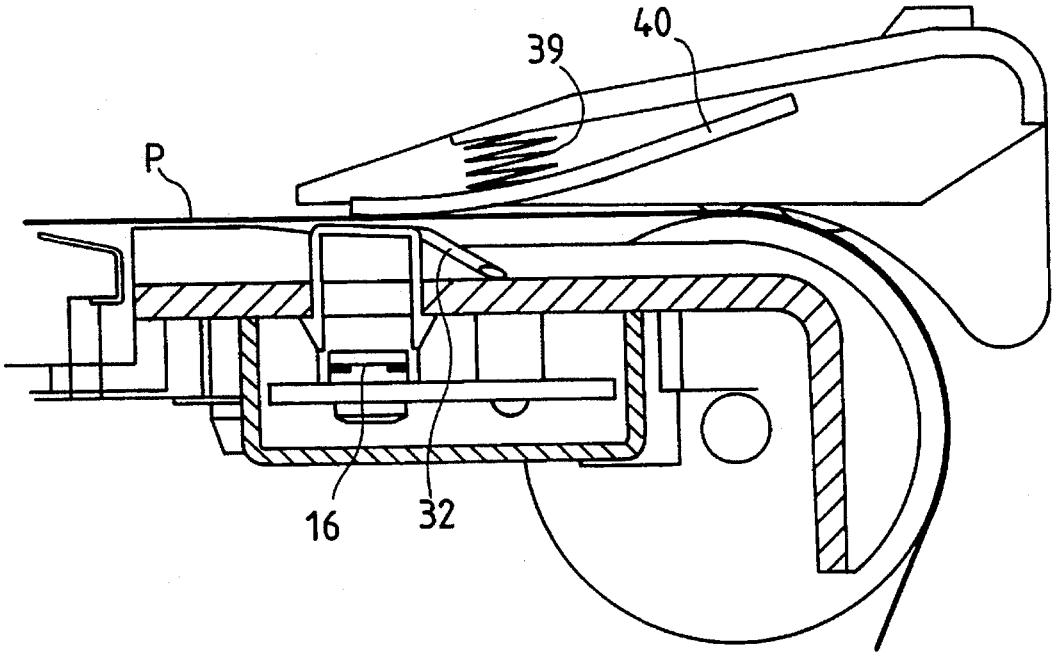
FIG. 9 is an explanatory view of an operation of a guide sheet in the third embodiment of the present invention.

As shown in FIG. 9, a guide member may be constituted by a spring 39 and a guide plate 40. The spring 39 and the guide plate 40 are arranged to avoid the optical axis. As in the first embodiment, the biasing force of the spring 39 is determined, so that the leading or trailing end of the recording medium contacts the dust attachment prevention cover with a weak force, and when the recording medium is stretched taut by a tension generated therebetween, the guide plate is withdrawn to prevent contact between the recording medium and the dust attachment prevention cover. In this embodiment, which uses a coil spring 39 with a small compression variation, a variation in biasing force among a large number of members can be decreased as compared to the first and second embodiments which suffer a relatively large variation in biasing force due to a variation in thickness of the guide member, thus stabilizing performance.

(Fourth Embodiment)

The fourth embodiment of the present invention will be described below with reference to FIG. 10. The same reference numerals in FIG. 10 denote the same parts as in the first embodiment, and a detailed description thereof will be omitted.

Figure 10:
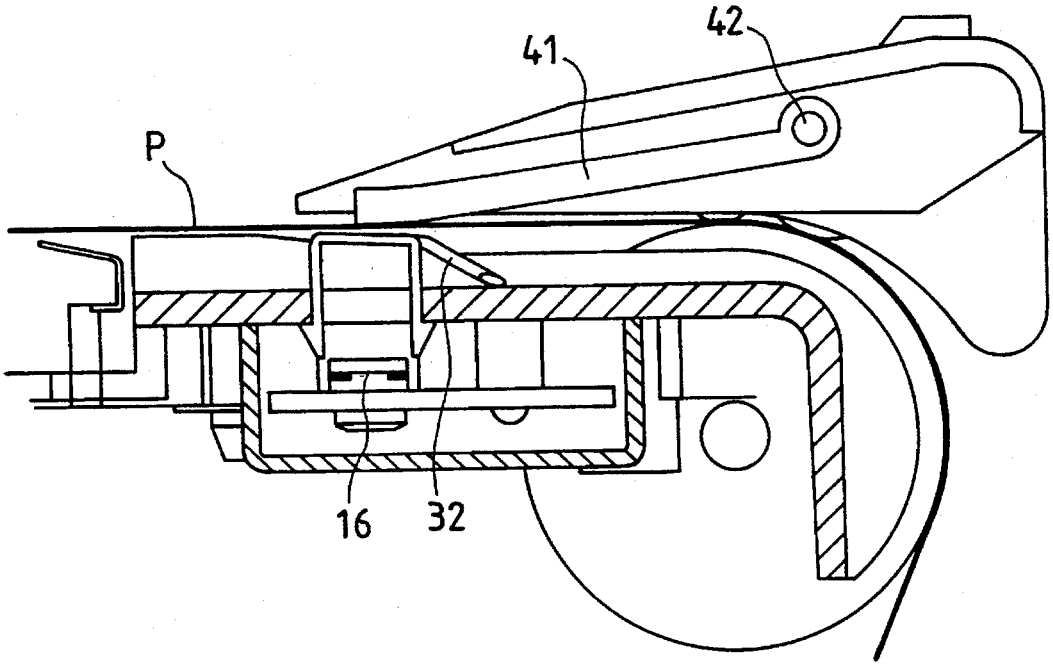
FIG. 10 is an explanatory view of an operation of a guide sheet in the fourth embodiment of the present invention.
Figure 11:
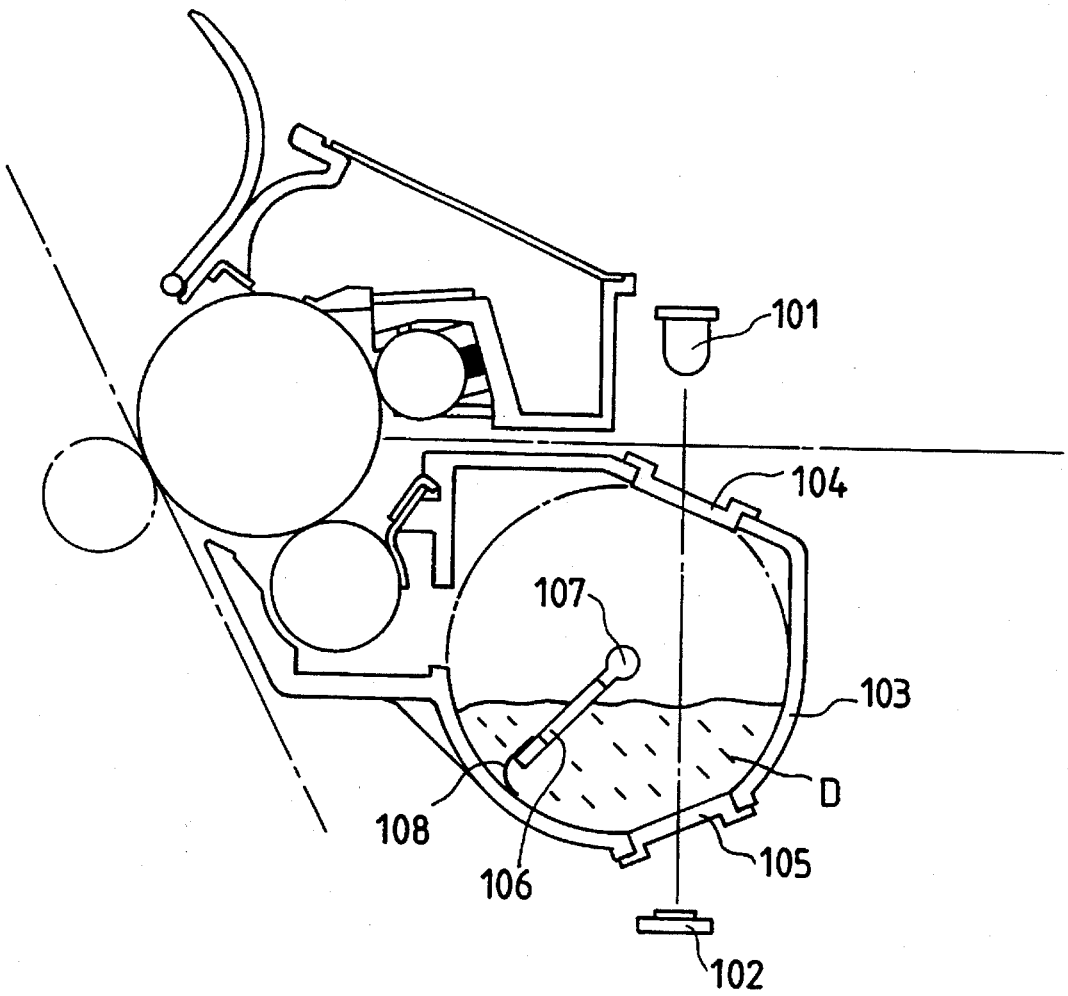
FIG. 11 is a sectional view of a developing agent presence/absence detection device.

As shown in FIG. 10, a guide member may be constituted by a guide plate 41 which hangs down by its own weight. In FIG. 10, the guide plate 41 is pivotally supported by a support shaft 42, but may be supported by other methods such as a drop-in method. The guide plate 41 is arranged to avoid the optical axis. As in the first embodiment, the weight and the way of hanging down of the guide plate 41 are determined, so that the leading or trailing end of the recording medium contacts the dust attachment prevention cover with a weak force, and when the recording medium is stretched taut by a tension generated therebetween, the guide plate is withdrawn (brought up) to prevent contact between the recording medium and the dust attachment prevention cover. In this embodiment as well, a variation in biasing force among a large number of members can be decreased as in the third embodiment, thus stabilizing performance.

The embodiments of the present invention have been described. However, the present invention is not limited to these embodiments, and various changes and modifications may be made within the spirit and scope of the invention.

What is claimed is:

1. An image forming apparatus comprising:

an image carrier;

a developer for developing an electrostatic latent image on said image carrier;

transfer means for transferring the developed image on said image carrier onto a transfer medium;

feed means for feeding the transfer medium to a transfer portion by said transfer means; and an optical element for optically detecting an amount of developing agent in said developer, said optical element being arranged at a side opposite to said developer with respect to a convey path of the transfer medium.

2. An apparatus according to claim 1, further comprising a light-transmitting cover for covering said optical element.

3. An apparatus according to claim 2, wherein when the transfer medium is stretched, said light-transmitting cover is separated from the transfer medium.

4. An apparatus according to claim 3, wherein an end portion of the transfer medium slidably contacts said light-transmitting cover.

5. An apparatus according to claim 4, wherein leading and trailing end portions of the transfer medium slidably contact said light-transmitting cover.

6. An apparatus according to claim 4, further comprising guide means including a guide member for biasing the transfer medium toward said light-transmitting cover.

7. An apparatus according to claim 6, wherein said guide means comprises a plurality of guide members arranged substantially parallel to each other.

8. An apparatus according to claim 6, wherein said guide member is arranged along a convey direction of the transfer medium.

9. An apparatus according to claim 6, wherein said guide member has an elasticity.

10. An apparatus according to claim 6, wherein said guide member includes a flexible member.

11. An apparatus according to claim 6, wherein said guide member biases the transfer medium by force of gravity.

12. An apparatus according to claim 1, wherein said image carrier and said developer integrally constitute a process cartridge which is detachably attached to an apparatus main body.

13. An apparatus according to claim 1, wherein said optical element forms an optical path extending through a bottom portion of said developer.

* * * * *